United States Patent [19]

Rosen

[11] 4,385,001

[45] May 24, 1983

[54] SELECTIVE REDUCTION OF EDIBLE OILS

[75] Inventor: Bruce I. Rosen, Skokie, Ill.

[73] Assignee: UOP Inc., Des Plaines, Ill.

[21] Appl. No.: 274,913

[22] Filed: Jun. 18, 1981

[51] Int. Cl.[3] ..... C11C 3/12

[52] U.S. Cl. ..... 260/409; 252/472

[58] Field of Search ..... 260/409; 252/472

[56] References Cited

U.S. PATENT DOCUMENTS 4,163,750 8/1979 Bird et al. ..... 260/409

4,169,101 9/1979 Ucciani et al. ..... 260/409

*Primary Examiner*—Thomas A. Waltz

*Attorney, Agent, or Firm*—James R. Hoatson, Jr.; Eugene I. Snyder; William H. Page, II

[57] ABSTRACT

Edible oils may be selectively hydrogenated using a zerovalent, supported, catalytically active cobalt catalyst. Where the cobalt is supported on alumina, the selectivity of hydrogenation is virtually independent of the nature of the alumina. The process is sufficiently selective that continuous hydrogenation may be performed with about the same selectivity as that presently obtained in batch processes using presently conventional catalysts.

13 Claims, No Drawings

SELECTIVE REDUCTION OF EDIBLE OILS

Although some edible oils are used per se, by far the largest portion are hydrogenated, or hardened, prior to their end use. The reason for such hydrogenation is to increase the stability of the final product. For example, processed soybean oil is susceptible to oxidation resulting in deterioration of its organoleptic properties upon storage even at ambient temperature. Where the oil is to be used at higher temperatures, for example, as a frying oil, the adverse organoleptic consequences of oxidation become even more pronounced.

The commonly accepted origin of oxidative deterioration is the presence of highly unsaturated components, such as the triene moiety, linolenate, in soybean oil. Partial hydrogenation to remove most of this component leads to a marked increase in the oxidative stability of the resulting product, thereby facilitating storage and permitting unobjectionable use at higher temperatures. Ideally, one desires this hydrogenation to be highly specific, reducing only triene to the diene, linoleate, without effecting cis to trans isomerization. In practice, this goal is unachievable.

The fats and oils which are the subject of this invention are triglycerides of fatty acids, some of which are saturated and some of which are unsaturated. In vegetable oils, the major saturated fatty acids are lauric (12:0), myristic (14:0), palmitic (16:0), stearic (18:0), arachidic (20:0), and behenic (22:0) acids. The notation, "18:0," for example, means an unbranched fatty acid containing 18 carbon atoms and 0 double bonds. The major unsaturated fatty acids of vegetable oils may be classified as monounsaturated, chief of which are oleic (18:1) and erucic (22:1) acids, and polyunsaturated, chief of which are the diene linoleic acid (18:2), and the triene linolenic acid (18:3). Unhardened vegetable fats and oils contain virtually exclusively cis-unsaturated acids.

In the context of partial hydrogenation, the ultimate goal is the reduction of triene to diene without attendant transacid formation or saturate formation. In practice, it is observed that partial reduction results in lowering both triene and diene and increasing the monoene, saturate, and trans levels. Because it is desired that the product of partial hydrogenation itself be a liquid oil relatively free of sediment or even cloudiness upon storage at, for example, 10° C., the formation of saturated and trans acids in such hydrogenation is a vexing problem. Removal of these solids, whose relative amount is measured by the Solid Fat Index (SFI), is a relatively costly and inefficient process attended by large losses associated with the separation of gelatinous solids from a viscous liquid. It is known in the art that such solids are composed largely of triglycerides containing at least one saturated fatty acid moiety and/or trans monounsaturated fatty acid moieties with the predominant culprits having at least 18 carbon atoms. It is further known in the art that fatty acid analysis alone is an insensitive analytical tool, that is to say, two products of hydrogenation of, for example, soybean oil may be vastly different in their SFI while having virtually identical fatty acid analysis. This arises because the distribution of the saturated moieties in the triglyceride is important. The solubility in the soybean oil of disaturated triglycerides is much less than twice the amount of monosaturated triglycerides, and the solubility of monosaturated triglycerides may depend upon whether the other fatty acid moieties of the triglyceride are monounsaturated, diunsaturated, etc., and may also depend upon whether the saturated portion is at the one- or two-position of the triglyceride. Hence, hydrogenation of edible fats and oils is largely an empirical process, whose analytical tools include SFI supported by fatty acid analysis. The difficulty of achieving desirable results, in the context of selectivity in Solid Fat Index, has largely limited such hydrogenation largely to a batch type process. Although the transition from a batch to a continuous process, especially of the fixed bed type, is conceptually facile, it will be recognized by the skilled worker that impediments have been substantial.

Reports on the use of cobalt as a catalyst in the reduction of edible oils have been sparse. U.S. Pat. No. 4,169,101 describes the use of micrometallic and ferromagnetic cobalt resulting from the decomposition of dicobalt octacarbonyl as a catalyst in the hydrogenation of edible oils. Although the process is there characterized as a selective hydrogenation, the data presented belie this description. It should be noted that in no reduction described by the patentee is the stearate (18:0) level under 7.8%, and even at such a relatively high saturate level the triene content is 2.4%. Thus, it is questionable whether the cited prior art method constitutes a selective hydrogenation of edible oils as that term is commonly used in the art, and this prior art method definitely is not selective as that term is defined within.

In the context of this application, a method of hydrogenation of edible oils is selective if it is capable of reducing the iodine value of soybean oil from about 10 to about 30 units with a concomitant increase in saturates of less than about 1.5% and a decrease in triene level to at least 3%, and where the Solid Fat Index of the partially hydrogenated product is less than about 5 at 50° F., less than about 2 at 70° F., less than 1 at 80° F., and 0 at 90° F.

It must be clearly recognized and understood that although this definition of selective hydrogenation utilizes a specific decrease in iodine value of a particular edible oil, a selective hydrogenation may cause a greater decrease in iodine value and/or be effected with a different edible oil. That is to say, the definition of selective hydrogenation does not restrict a selective hydrogenation to the conditions of its definition.

The fundamental observation which forms the cornerstone for the invention described herein is that zerovalent, supported, catalytically active cobalt is an especially selective catalyst for the hydrogenation of edible oils. An advantage in addition to its selectivity is that such a cobalt catalyst when supported on alumina shows selectivity which is virtually independent of, and uninfluenced by, the nature of the support. A further advantage of cobalt catalysts is that they may be effectively used in a continuous hydrogenation process for edible oils, which will be recognized to be a highly desirable but extraordinarily elusive goal.

SUMMARY OF THE INVENTION

An object of this application is to provide a method of selectively hydrogenating edible fats and oils. An embodiment comprises contacting edible oils and fats with a zerovalent, supported, catalytically active cobalt at a temperature from about 150° to about 300° C. at a hydrogen pressure less than about 200 psig. In a more specific embodiment, the cobalt is supported on alumina. In a still more specific embodiment, the pressure is from about 25 to about 150 psig.

DESCRIPTION OF THE INVENTION

The subject matter disclosed is a method of selectively hydrogenating edible oils and fats comprising contacting the edible oil or fat with an effective amount of zerovalent, supported, catalytically active cobalt at a temperature from about 150° C. to about 300° C. in the presence of hydrogen at a pressure less than about 200 psig, and recovering the resulting hydrogenated product.

The method described herein is generally applicable to edible oils and fats. Because the partial hydrogenation of liquid oils to afford hardened, but still liquid, oils occupies a prominent part within the domain of hydrogenation of edible oils and fats, the method of this invention is particularly applicable to such partial hydrogenation. Thus, the described method of hydrogenation is especially useful to partially harden edible liquid oils whereby the iodine value (IV) is lowered from about 10 to about 30 units by hydrogenation, whereby the increase in saturates attending hydrogenation is less than about 1.5%, whereby the triene level is reduced to at least 3%, and whereby the partially hydrogenated product has an SFI of less than about 5 at 50° F., less than about 2 at about 70° F., less than 1.0 at 80° F., and 0 at 92° F. The term "iodine value" is a measure of the total extent of unsaturation in an edible oil or fat as performed by a standard test. In the context of soybean oil, which is a particularly important liquid vegetable oil, partial hardening is continued to an IV drop of from about 15 to about 25 units, with the product having less than about 6% stearate and less than about 3% linolenate.

Although the method claimed herein is especially valuable when applied to the partial hydrogenation of liquid vegetable oils, it must be explicitly recognized that the selectivity of the claimed method is also manifested in more extensive hydrogenations. Thus, as is shown below, the claimed method may be used generally in hydrogenating edible oils whenever selective hydrogenation is desired.

The method of this invention is especially applicable to liquid vegetable oils. Examples of such oils include soybean oil, cottonseed oil, sunflower oil, safflower oil, rapeseed oil, and liquid fractions from palm oil. The application of this method to soybean oil is especially important. As will be recognized by those skilled in the art, partial hydrogenation of liquid oils to afford partially hardened liquid oils is especially demanding, hence it is to be expected that a method suitable for this task also is suitable for more extensive hydrogenation. Thus, the method described herein also is suitable for more extensive hydrogenation, where the IV of the product may be as low as about 70. Oils and fats which can be so hydrogenated include those above, their partially hydrogenated products, and also such feedstocks as palm oil.

The catalyst used in this invention is zerovalent, supported, catalytically active cobalt. Although alumina is the preferred support, other supports which may be used, although not necessarily with equivalent results, include kieselguhr, silica, zeolites, and carbon.

When alumina is used as the support, the catalyst system has the important attribute that the nature of the alumina is unimportant. That is to say, the alumina is truly inert, acting merely as a carrier to disperse cobalt. It is found that the catalyst is functionally independent of the particular kind of alumina used (for example, alpha or gamma), the surface area of the alumina, its pore distribution and pore volume, and other properties commonly used to characterize a particular kind of alumina.

The catalyst used in the method of this invention typically is prepared by reducing a suitable cobalt salt impregnated on the support. Such reduction is most conveniently effected by a stream of hydrogen at a temperature between about 400° and about 600° C. Other methods are also satisfactory, as for example, the methods commonly employed to prepare Raney-type cobalt.

The concentration of cobalt may range from about 1 to about 25% by weight of the support. The choice of cobalt loading will depend, inner alia, on the degree of selectivity and catalyst life desired in a particular operation. The cobalt catalysts used in this invention are effective in amounts from about 0.01 to about 5% cobalt, based on edible oil hydrogenated, with the range from about 0.01 to about 1% being preferred, and with the lower end of this range being particularly preferred.

Hydrogenation conditions embrace a temperature from about 150° to about 300° C. at a hydrogen pressure from atmospheric up to about 200 psig. Because the selectivity of hydrogenation seems to increase with increasing temperature and decreasing pressure, there is some advantage to operating at the highest possible temperature and lowest possible pressure consistent with an acceptable reaction rate. Operationally, a temperature range from about 200° to about 260° C. is preferred. The preferred range of pressure is from about 25 to about 150 psig, with a range from about 50 to about 100 psig being still more preferred.

The method of this invention is equally applicable to a batch or continuous process. In a batch process, the oil to be hydrogenated is mixed with an effective amount of cobalt catalyst, and the mixture brought to the desired temperature, which is preferably from about 200° to about 260° C. The mixture is then vigorously agitated under hydrogen pressure, preferably from about 25 to about 150 psig, for a time sufficient to effect the desired degree of hydrogenation, at which time agitation is stopped and catalyst is removed, as by filtration. Hydrogenation time or duration, which depends upon the extent of hydrogenation desired, the oil used, the catalyst concentration, and hydrogenation temperature and pressure, may be from about 0.5 hr. up to about 10 hr. The resulting hydrogenated edible oil or fat is then recovered for subsequent processing.

The following description is applicable to a fixed bed operation, although it will be recognized that by suitable changes it may also be applicable to expanded or fluidized bed operation. The catalyst bed may be in the form of pellets, granules, spheres, extrudate, and so forth. The reactor is heated to the desired reaction temperature in a hydrogen atmosphere, often with a small hydrogen flow. After attainment of the desired temperature, the feedstock of edible fats and oils is made to flow over the fixed bed. The flow may be either downflow, as in a trickle bed operation, or upflow, as in a flooded bed operation. The flow rate of the oil may be from about 1 to about 20 LHSV, with rates from about 1 to about 5 being more common. When the flow of edible fats and oils is initiated, it is desirable to mix the hydrogen with said fats and oils so as to maintain the desired pressure. Often it is advantageous to admit excess hydrogen, maintaining pressure by partial venting. As the reaction proceeds and the activity of the catalyst bed decreases, adjustments may be made either in the LHSV or the temperature to maintain the desired characteristics of the product. Partially hardened oil is recovered as the effluent in a state suitable for further processing, such as blending, bleaching, or deodorization.

The examples given below are for illustrative purposes only, and are not to be construed as limiting this invention in any way.

EXAMPLE 1

The cobalt catalysts were prepared in the following general way. Material used as the support was mixed with an aqueous solution of $Co(NO_3)_2.6H_2O$ containing an amount of cobalt sufficient to provide the desired catalyst loading. Water was removed by evaporation with mixing, and the resulting solid was calcined in air at 450° C. for about 2 hours followed by reduction in a stream of hydrogen at a about 450° C. for about 2 hours.

TABLE 1

PROPERTIES OF ALUMINA SUPPORTS

| | alpha-Alumina | gamma-Alumina (Type P) | gamma-Alumina (Type R) |
|---|---|---|---|
| Apparent bulk density, g/ml | 1.4 | 0.3 | 0.5 |
| Surface area, $m^2/g$ | 3 | 160 | 200 |
| Micropore volume[a], ml/g | 0.03 | .37 | 0.5 |
| Macropore volume[b], ml/g | 0.2 | 1.4 | 0.3 |

[a]Micropore volume is the total volume of pores under about 117 anstroms in size.
[b]Macropore volume is the total volume of pores greater than about 117 angstroms in size, as determined by ANSI/ASTM D 2873-10.

EXAMPLE 2

Batch reactions were performed in a 350 cc stirred autoclave using 55 ml soybean oil and 5 g of a 5% Co catalyst. After being purged with nitrogen, hydrogen was admitted and the temperature was adjusted to the desired point. When the desired temperature was attained, hydrogen pressure was adjusted and stirring was begun. Aliguots were taken at intervals and filtered through Celite prior to analysis. Representative results at 220° C. and 50–100 psig hydrogen are presented in Table 2.

TABLE 2

BATCH REDUCTION OF SOYBEAN OIL

| | | |
|---|---|---|
| IV(Calcd) | 119.6 | 107.4 |

TABLE 2-continued

BATCH REDUCTION OF SOYBEAN OIL

| | | |
|---|---|---|
| 16:0 | 10.6 | 11.0 |
| 18:0 | 4.7 | 5.0 |
| 18:1 | 34.6 | 45.3 |
| 18:2 | 46.5 | 37.0 |
| 18:3 | 3.6 | 1.7 |

EXAMPLE 3–12

Hydrogenations were conducted in a reactor of conventional design containing a fixed bed of 15 to about 70 ml catalyst. The reactor had a preheater section for bringing feedstock to temperature and a heater for the reaction zone. The feedstock, which was soybean oil in these samples, was passed upflow by a metering pump and mixed with hydrogen before the preheater stage. In all cases there was a net excess of hydrogen, that is, hydrogen in excess of that necessary for reaction was introduced into the reaction zone and excess hydrogen was vented so as to maintain a constant pressure.

Iodine values were determined by AOCS method CD1-25 or were calculated from the measured fatty acid distribution. Solid fat index was determined by AOCS method CD10-57. Fatty acid distribution was determined by AOCS method CE2-66.

"The values $S_{LN}$ and $S_{LO}$ are the relative rates of triene versus diene reduction and diene versus monoene reduction, respectively, and were calculated using a computer program furnished by the U.S. Department of Agriculture, Northern Regional Laboratories, as described in *J. Amer. Oil Chemists Soc.*, 56, 664 (1979)."

TABLE 3

CONTINUOUS HYDROGENATION OF SOYBEAN OIL

| Catalyst | Example | Pressure T. °C. | psig | LHSV | $H_2$/Feed, moles/mole | 18:3 | 18:2 | 18:1 | 18:0 | 16:0 | IV (calc) | $S_{LN}$ | $S_{LO}$ |
|---|---|---|---|---|---|---|---|---|---|---|---|---|---|
| 5% Co on | 3 | 233 | 50 | 1.4 | 4.7 | 3.6 | 45.5 | 35.7 | 4.8 | 10.5 | 118.7 | 2.9 | 15.4 |
| alpha-alumina, | 4 | 220 | 90 | 2.2 | 8.0 | 4.3 | 46.7 | 33.8 | 4.7 | 10.6 | 121.0 | | |
| 1/16" | | | | | | | | | | | | | |
| 5% Co on | 5 | 223 | 90 | 8.0 | 3.5 | 3.5 | 41.8 | 39.8 | 4.8 | 10.3 | 115.5 | | |
| gamma alumina, | 6 | 220 | 90 | 7.0 | 4.2 | 2.7 | 41.2 | 40.5 | 5.3 | 10.3 | 113.3 | 2.7 | 15.2 |
| Type P, 1/16" | 7 | 255 | 90 | 6.3 | 4.7 | 1.2 | 33.0 | 49.4 | 6.1 | 10.4 | 102.6 | 2.9 | 14.2 |
| | 8 | 226 | 50 | 7.0 | 4.2 | 2.7 | 41.7 | 40.0 | 5.3 | 10.3 | 113.6 | | |
| 5% Co on | 9 | 224 | 50 | 3.7 | 4.2 | 2.9 | 40.0 | 42.2 | 4.6 | 10.3 | 113.0 | | |
| gamma alumina, | 10 | 245 | 50 | 3.7 | 4.2 | 1.9 | 37.0 | 45.8 | 4.9 | 10.4 | 108.3 | 2.7 | 35.3 |
| type R, 1/16" | 11 | 246 | 90 | 3.7 | 4.2 | 1.1 | 31.9 | 50.8 | 5.8 | 10.5 | 101.7 | 2.8 | 17.5 |
| | 12 | 248 | 90 | 2.3 | 6.6 | — | 21.8 | 59.6 | 8.1 | 10.5 | 88.9 | | |

TABLE 4

TRANS CONTENT OF PARTIALLY HARDENED SOYBEAN OIL

| Catalyst | IV | % Trans |
|---|---|---|
| 5% Co on | 102.3 | 37.7 |
| Type P alumina | 104.5 | 35.9 |
| | 114.9 | 24.9 |
| 5% Co on | 101.9 | 37.3 |
| Type R alumina | 117.7 | 18.3 |
| | 109.4 | 20.9 |
| 5% Co on alpha-alumina | 123.1 | 18.4 |

TABLE 5

SOLID FAT INDEX OF PARTIALLY HYDROGENATED SOYBEAN OIL

| IV | 113 | 103 | 113 | 108 | 102 | 88 |
|---|---|---|---|---|---|---|
| SFI: 50° F. | 2.2 | 11.2 | 1.3 | 4.3 | 11.0 | 25.9 |
| 70° F. | 0 | 3.4 | 0 | 0.4 | 3.0 | 12.5 |
| 80° F. | 0 | 1.0 | 0 | 0 | 0.7 | 6.3 |

TABLE 5-continued

| SOLID FAT INDEX OF PARTIALLY HYDROGENATED SOYBEAN OIL | | | | | | |
|---|---|---|---|---|---|---|
| IV | 113 | 103 | 113 | 108 | 102 | 88 |
| 92° F. | 0 | 0 | 0 | 0 | 0.1 | 0 |
| 104° F. | 0 | 0 | 0 | 0 | 0 | 0 |
| Catalyst | a | a | b | b | b | b |

a 5% Co on alumina, Type P
b 5% Co on alumina, Type R

What is claimed is:

1. A method of selective hydrogenation of edible oils and fats comprising contacting the edible oils and fats with a catalytically effective amount of a catalyst consisting of zerovalent cobalt catalyst prepared by reduction of a cobalt salt composited on an alumina support in the presence of hydrogen under hydrogenation conditions, and recovering the resulting hydrogenated product.

2. The method of claim 1 wherein said edible oils and fats are liquid vegetable oils.

3. The method of claim 2 wherein said liquid vegetable oils are selected from the group consisting of soybean oil, cotton seed oil, rapeseed oil, sunflower oil, safflower oil, and liquid fractions from palm oil.

4. The method of claim 3 wherein said oil is soybean oil and contacting is of a duration sufficient to lower the iodine value from about 15 to about 25 units.

5. The method of claim 1 wherein the effective amount of cobalt is from about 0.01 to about 5% by weight based on the edible oil.

6. The method of claim 1 where cobalt is supported on alumina.

7. The method of claim 6 where the alumina is alpha-alumina.

8. The method of claim 6 where the alumina is gamma-alumina.

9. The method of claim 1 where the hydrogenation conditions embrace a temperature from about 150° C. to about 300° C., and the pressure is from atmospheric up to about 200 psig.

10. The method of claim 9 where the temperature is from about 200° to about 260° C.

11. The method of claim 9 where the pressure is from about 25 to about 150 psig.

12. The method of claim 11 where the pressure is from about 50 to about 100 psig.

13. The method of claim 1 where the hydrogenation is a continuous hydrogenation.

* * * * *